United States Patent [19]

Adams

[11] 4,361,189

[45] Nov. 30, 1982

[54] AUTOMATIC FIRE EXTINGUISHING AND ALARM SYSTEM FOR MOBILE HOMES

[76] Inventor: Lyle G. Adams, 5750 Clear Creek Dr., Denver, Colo. 80212

[21] Appl. No.: 90,658

[22] Filed: Nov. 2, 1979

[51] Int. Cl.[3] ..... A62C 35/12

[52] U.S. Cl. ..... 169/14; 137/87; 169/16; 169/23; 169/62; 169/90; 200/81.9 R; 340/610

[58] Field of Search ..... 169/14, 15, 16, 17, 169/18, 19, 23, 37, 62, 90; 137/87; 361/103, 178; 340/606, 610, 611, 592; 200/81.9 R, 182

[56] References Cited

U.S. PATENT DOCUMENTS

| | | | |
|---|---|---|---|
| 231,715 | 8/1880 | Grinnell | 169/19 |
| 941,053 | 11/1909 | Young | 200/81.9 R |
| 996,110 | 6/1911 | Miller . | |
| 1,308,974 | 7/1919 | Arvintz . | |
| 1,620,876 | 3/1927 | Currivan . | |
| 1,866,253 | 7/1932 | Donohue | 169/19 X |
| 2,752,934 | 7/1956 | Badberg | 169/14 X |
| 3,065,316 | 11/1962 | Olson | 200/81.9 R |
| 3,288,224 | 11/1966 | Trudeau . | |
| 3,473,544 | 11/1969 | Nielsen, Jr. . | |
| 3,645,338 | 2/1972 | Livingston | 169/16 |
| 3,653,443 | 4/1972 | Dockery | 169/19 X |
| 3,743,022 | 7/1973 | Livingston | 169/16 |
| 3,761,657 | 9/1973 | Miller | 200/81.9 R |
| 3,802,510 | 4/1974 | Johnson . | |
| 3,810,511 | 5/1974 | James | 169/23 X |
| 3,848,676 | 11/1974 | Doherty, Jr. . | |
| 3,877,527 | 4/1975 | Johnson | 169/90 |
| 3,993,139 | 11/1976 | Vaughn | 169/62 |
| 4,091,876 | 5/1978 | Valdatta | 169/62 |

*Primary Examiner*—Gil Weidenfeld
*Assistant Examiner*—Fred A. Silverberg

[57] ABSTRACT

A self-contained fire protection system can be supplied in kit form and is specifically adapted for installation by a novice in prefabricated or site built housing, such as, a mobile home, travel trailer or like building structure. The system comprises an inlet delivery line which can be suspended beneath the floor of the mobile home and attached to a source of water under pressure with one or more risers extending upwardly from the delivery line through the floor into the interior of the mobile home, and upper branch lines containing automatic sprinkler heads are arranged in series in each branch line and can be attached directly to the risers and inlet line as well. The delivery line has a dual check valve and water flow indicator or switch, the latter being responsive to opening of any one or more of the sprinkler heads to activate a shunt trip breaker circuit so as to automatically interrupt electrical service to the home including the gas line into the home while activating an alarm circuit. Compression-type fittings permit sealed interconnection of relatively lightweight tubing which comprise the delivery line, risers and branch lines and permit ready disassembly of the various lines when the mobile home or trailer is being transported to another site.

12 Claims, 9 Drawing Figures

AUTOMATIC FIRE EXTINGUISHING AND ALARM SYSTEM FOR MOBILE HOMES

This invention relates to a novel and improved fire extinguishing and alarm system and more particularly relates to a fire extinguishing and alarm system which is specifically adaptable for installation by a novice in site built or prefabricated housing, such as, mobile homes, travel trailers and other types of recreational vehicles so as to greatly minimize damage resulting from fires.

BACKGROUND OF THE INVENTION

Fire protection systems presently in use either necessitate installation at the time that a residence or other housing unit is being built, or would require substantial repair or reconstruction when installed in an existing dwelling. Numerous improvements have been devised in the individual components of such systems, such as, automatically controlled on-off sprinkler heads and sensing devices to sense the temperature and to regulate the delivery of water to the sprinkler heads. However, as sprinkling systems have become increasingly complex combined with the attendant costs of installation, portable fire extinguishers have become increasingly popular because of their reduced costs. This is particularly true in the case of mobile homes and campers, since at the present time, self-contained fire protection systems have not been available which can be installed in existing mobile homes. Indeed, I am not aware of any self-contained fire protection system which is now commercially available as original equipment for mobile homes or travel trailers. On the other hand, fire protection systems for permanent homes or residences required considerable skill and expertise by professional or contract labor in the installation of such systems. The practice has been to run any plumbing through the interior or insulating space behind the walls into individual sprinkler heads which are flush-mounted either in the walls or ceiling surfaces. Thus, systems presently available have not lent themselves well for installation as a part of the mass or volume production of mobile homes or other recreational vehicles. Yet the danger of fires is equally as great in such dwellings as in residential homes.

It is therefore highly desirable to provide a self-contained fire protection system which can be connected to the domestic water supply for a mobile home, is fully automatic in controlling the activation and deactivation of sprinkler heads located in the system so that selected heads may be activated only for the time interval required to completely extinguish the fire, and further provides the necessary interlocking control for the fuel and power sources into the mobile home so as to automatically deactivate such sources when a fire is in progress but nevertheless furnish the necessary power to trigger an alarm. In addition, it is important that such a system be conformable for installation into new as well as existing mobile homes or other dwellings by anyone without necessity of installing same as a permanent fixture or otherwise modifying the structure of the dwelling; in other words, to provide a self-contained or stand-alone system which can be made available in kit form and installed with a minimum of time and labor required.

Representative patents which show permanent or built-in fire protection systems for dwellings are U.S. Pat. Nos. 1,866,253 to Donahue, 231,715 to Grinell and 1,308,974 to Arvtinz. For example, Donahue discloses a sprinkler system having automatic sprinkler heads activated by the melting of a fusible link and where the system is connected both to an alarm circuit and a gas shut-off valve. Fully automatic on-off sprinkler heads have also been designed and which are specifically adapted to be mounted in the wall or ceiling of a building so that in response to a certain temperature level the head will open to direct a spray of water into a room or space and to close upon a predetermined drop in temperature. Representative U.S. Pat. Nos. are to W. Z. Johnson 3,802,510 and 3,877,527. Representative of the patents which employ automatic shut-off valves for gas supply as well as to activate an alarm circuit in response to a predetermined rise in temperature are Miller U.S. Pat. No. 996,110, Currivan U.S. Pat. No. 1,620,876 and Neilson U.S. Pat. No. 3,473,544.

SUMMARY OF THE INVENTION

It is therefore an object of the present invention to provide for a novel and improved self-contained fire protection system which is conformable for use in new or existing dwellings including but not limited to residential homes, mobile homes, campers and other recreational vehicles.

It is another object of the present invention to provide for a fire protection system which can be manufactured and sold in kit form for installation as a self-contained unit in new or existing homes or dwellings of the type described, is fully automatic, readily connectable and disconnectable and highly reliable on operation.

A further object of the present invention is to provide for a novel and improved fire protection system which is capable of selectively directing a fire extinguishing spray through one or more sprinkler heads which are strategically located within a home or dwelling in such a way that only those sprinkler heads in the immediate locale of the fire will be activated and upon extinguishing the fire will be automatically deactivated; and further wherein the system is capable of automatically triggering an alarm in response to a fire while automatically cutting off any gas supply or electrical power to the rest of the dwelling.

It is still a further object of the present invention to provide for a novel and improved self-contained fire extinguishing and alarm system specifically adaptable for use in mobile homes and travel trailers which is highly versatile and readily conformable for installation as a free-standing system within the unit or dwelling; and further wherein the system will permit selective filling with antifreeze during the winter months and affords ease of inspection, repair and maintenance as required.

In accordance with the present invention, there has been devised a novel and improved fire extinguishing and alarm system which can be sold in kit form for installation by the individual owner on travel trailers, mobile homes and other dwellings. The only positive connections required are to the usual domestic water supply line provided for the dwelling and connection of the fire protection electrical control panel to a main panel. A main conduit is connected to the domestic water supply and contains sensing means in the form of a water flow switch or indicator together with a dual check valve, and the main conduit forms a part of a network of conduits or lines suspended beneath the floor or chassis of the dwelling. Risers are arranged at spaced intervals for extension upwardly through openings in the floor and which terminate in one or more horizontally extending branch lines having sprinkler heads located at spaced intervals therein. Thus the sprinkler heads in each riser are series-connected into the main conduit or line and each may be of the automatic on-off type so as to be individually responsive to heat and activated independently of the other sprinkler heads; and similarly will automatically shut off upon reduction in heat or temperature. The system is further characterized by having an electrical control including a main circuit breaker which coordinates activation of one or more sprinklers with the activation of an alarm circuit while deactivating the gas and power to the rest of the dwelling. A separate inspection and fill line is connected into the main network beneath the dwelling or mobile home to permit filling with antifreeze when desired and to permit inspection of the pressure level or liquid in the lines. This will also permit activation of the electrical shut-down and alarm without flowing water within the unit. The circuit breaker may be furnished simply with a plug-in connection to a three-wire 120 volt outlet to provide the necessary electrical control for the entire system.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
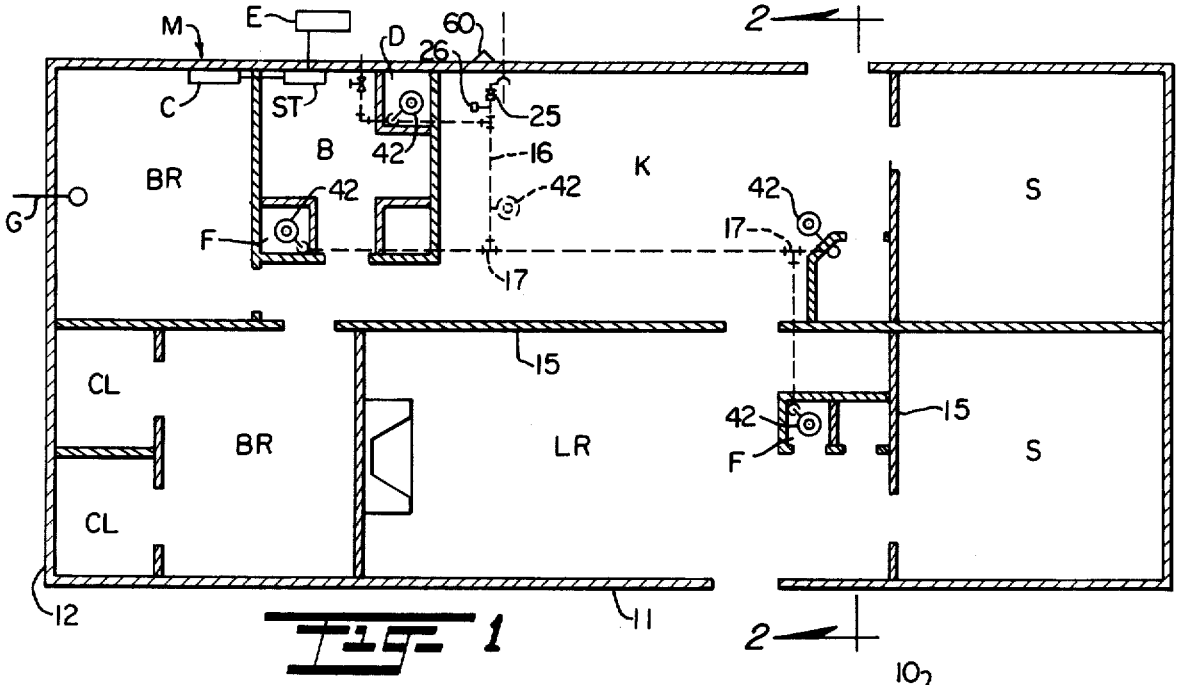
FIG. 1 is a top plan view of a preferred form of fire protection system installed in a mobile home in accordance with the present invention and generally illustrating the placement and arrangement of the water supply lines and sprinkler heads.
Figure 2:
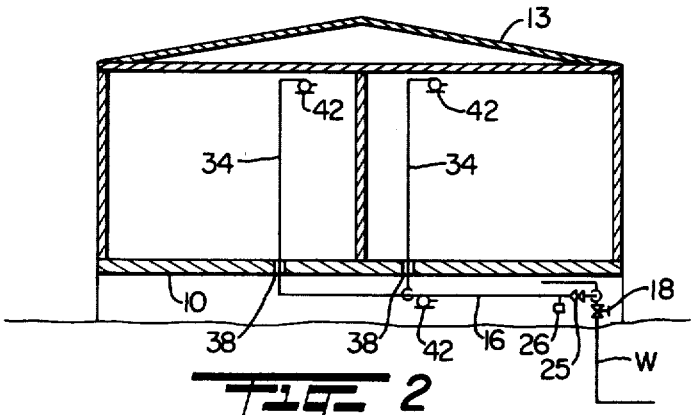
FIG. 2 is a cross-sectional view of the preferred form of invention taken about lines 2—2 of FIG. 1.

FIGS. 1 to 6 illustrate a preferred form of the present invention. Specifically in FIGS. 1 and 2 there is illustrated the installation of a preferred form of fire protection system in a large mobile home installation generally represented at M which has access to the standard utilities or service including a gas line designated at G, a domestic water supply designated at W and an outside electrical service panel designated at E. The mobile home M is illustrated to typify various types of mobile homes or travel trailers which have the necessary fittings for connection to a suitable source of natural gas or propane, domestic water supply and electrical service which are available in trailer parks, campgrounds or recreational areas throughout the country. Conventionally, the mobile home M as illustrated includes a floor or base 10 which is supported in spaced relation above the ground surface, for example, as illustrated in FIG. 2. It further includes outer walls 11, end walls 12 and a roof 13. The interior of the mobile home may be one large area but, at least in larger installations, is suitably partitioned into separate rooms. For this purpose, a number of the interior walls are illustrated and designated at 15 so as to provide a separate kitchen area K, bathroom B, bedrooms BR, livingroom LR, closets CL and other storage or family room areas designated at S, furnace areas designated at F, a domestic water heater is represented at D.

Figure 5:
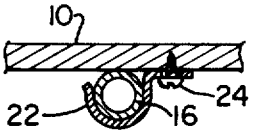
FIG. 5 is a sectional view in detail illustrating the mounting of a water supply line to the subflooring of a motor home.
Figure 6:
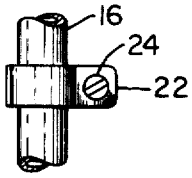
FIG. 6 is another view of the mounting bracket shown in FIG. 5.
Figure 3:
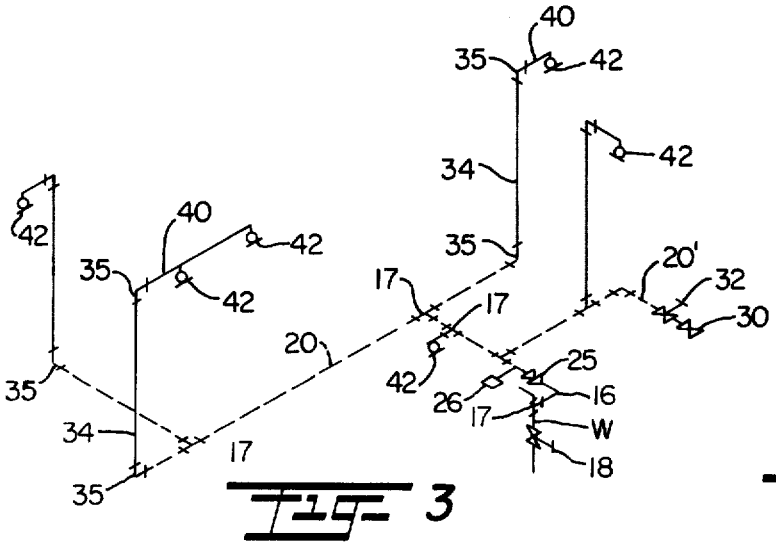
FIG. 3 is a schematic view of the preferred form of fire protection system.
Figure 4:
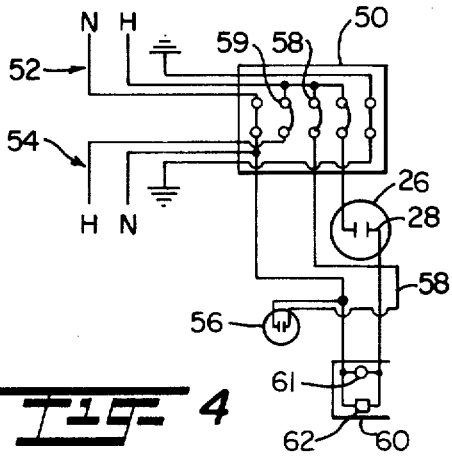
FIG. 4 is a view schematically illustrating the electrical control circuit for the preferred form.

In accordance with the present invention, a preferred form of fire protection system is schematically illustrated in FIG. 3 and broadly is so constructed and arranged as to be available in kit form so as to permit installation in an existing mobile home, such as, illustrated in FIGS. 1 and 2 with a minimum of skill, effort and time required and while complying with all applicable codes for such installations. In the preferred form, a main inlet line or pipe 16 is connected by a T-fitting 17 to the domestic water supply W directly above or downstream of a manual shut-off control valve 18. The inlet line may for example consist of copper tubing dimensioned to correspond to the diameter of the water supply W and for example may consist of ¾" or 1" copper tubing; and a series of branch lines or pipes 20 are connected by T-fittings 17 to the inlet line 16 as shown. The main line 16 and branch lines 20 are so interconnected as to extend horizontally and for example to permit horizontal extension beneath the floor 10 of the mobile home. Suitable hanger brackets 22, as illustrated in FIGS. 5 and 6, are located at spaced intervals to support the horizontally extending supply lines 16 and 20 to the underside of the flooring 10, each hanger bracket being secured by suitable fasteners such as a bolt 24. A dual check valve 25 is positioned in the main inlet line 16 in order to prevent back or reverse flow of liquids or fluids in the line, and a water flow switch 26 is connected in series with the dual check valve in the line 16 upstream of any of the branch lines 20. The water flow switch 26, as represented in FIG. 4, has normally open contacts 28 in the electrical control circuit to be hereinafter described.

Additionally, one of the branch lines 20 includes an extension line 20' which terminates in a special orifice fitting 30 of reduced size which will permit introduction of special additives into the system, such as, an antifreeze and/or suitable fire retardant additives. A manual shut-off or control valve 32 is positioned adjacent to the fitting 30 so as to permit suitable or appropriate testing or inspection of the fluids in the line.

In order to conduct fluid from the main supply line 16 and branch lines 20 into the interior of the mobile home, risers 34 are connected by elbow fittings 35 to extend upwardly from the branch lines 20 into each area of the home to be protected. Each riser 34 is appropriately made up of the same diameter tubing or pipe as the branch lines 20 and is dimensioned to extend upwardly through an opening 38 in the flooring 10 for the greater distance or height of the room area. The upper ends of the risers are connected by elbow fittings 35 to horizontal sprinkler lines 40 to which are connected sprinkler heads 42. As illustrated in FIG. 3, one or more sprinkler heads 42 can be connected in series to a single branch line. Preferably, each sprinkler head 42 is of the heat sensitive, on-off type which will automatically open and close as heat conditions dictate. One suitable type of sprinkler head is the automatic sprinkler head manufactured and sold by Central Sprinkler Corporation of Lansdale, Pa. and which employs a special wax to control opening and closing of the valve element in the sprinkler head. Essentially when the wax is liquified at a predetermined heat or temperature level, it will open a cam to permit the sprinkler head to discharge liquid from the system into the room or other space; however, when the wax temperature reduces and solidification occurs, the cam is operated to close the water passage and stop water flow. Each sprinkler head is capable of operating independently of the other so that in the event of fire if one sprinkler head in a line is activated to an open position it may discharge the fluid from that head irrespective of the opening or closing of the other sprinkler heads in that line. The water flow switch 26 operates in response to opening of any one of the individual sprinkler heads to signal the electrical control circuit that one of the sprinkler heads is in operation. One suitable type of water flow indicator is that manufactured and sold under the trademark FLO-CATER by Gunau Sprinkler of Milwaukee, Wis. Essentially, whenever the liquid in the line is static, i.e., not flowing through any of the sprinkler heads, the switch 26 will remain in the normally open position. However, when one of the heads is opened and flow occurs through the main supply line 16, it will cause a vane in the water flow switch to advance the switch to a closed position so as to make or close the electrical control circuit through that line in a manner to be described.

Another feature of the present invention resides in the electrical control circuit which in response to closure of the water flow indicator will simultaneously interrupt electrical service to the mobile home while activating an alarm circuit. Referring specifically to FIG. 4, the electrical control circuit comprises a shunt trip breaker 50 disposed in the panel ST illustrated in FIG. 1 with a three-line cable represented at 52 adapted to be connected into the electrical service E and another three-line cable represented at 54 adapted to be connected into the circuit breaker C in the mobile home. Each cable includes a neutral or negative lead designated N, a positive or hot lead designated H and a ground lead as indicated. A gas solenoid valve 56 in the gas line G includes a normally open switch having its negative side connected in series to the negative side of the power cable 52 and the positive side connected by a shunt connection 58 in parallel to shunt connection 59 between the positive leads of the cables 52 and 54 in the shunt trip breaker. In turn, the water flow switch 26 has its normally open contacts 28 connected in parallel to the positive sides of the gas solenoid valve 56 and cable 54 in the shunt trip breaker, and the normally open contacts 28 are in turn connected in series to alarm circuit 60 which as shown is located on the outside of the building and may be suitably comprised of a series-connected light 61 and audible alarm 62. The negative side of the alarm circuit 60 is connected to the negative side of the gas solenoid valve 56 as indicated. Accordingly, when the normally open contacts 28 of the water flow switch 26 is closed, it will operate through the shunt trip breaker 50 to break or open the circuit to the circuit breaker C and gas solenoid valve 56 while closing the circuit into the alarm circuit 60. One suitable type of shunt trip breaker 50 is that manufactured and sold by Cutler-Hammer of Milwaukee, Wis., and may suitably have a plug-in cable connection 52 into the electrical service E as well as a plug-in connection from the shunt trip breaker 50 through cable 54 to the mobile home circuit breaker panel C. Once shunted, the circuit breaker 50 must be manually reset in order to restore electrical service to the mobile home.

FIGS. 1 and 2 illustrate a typical installation of the fire protection system of the present invention in a permanent mobile home installation. Essentially, the only modification required to the mobile home itself is the wall mounting of the shunt trip breaker 50 and the drilling of holes 38 through the flooring at selected intervals to permit upward extension of the risers 34. The risers may be located in such a manner as to extend upwardly through utility or closet areas so as to be hidden from view, then to have their branch lines 40 extend a limited distance into the room areas. As best seen from FIG. 1, the sprinkler heads may be strategically located so as to be concentrated more in those parts of the mobile home which are more fire-prone, such as, the kitchen, furnace and hot water heater areas.

Figure 7:
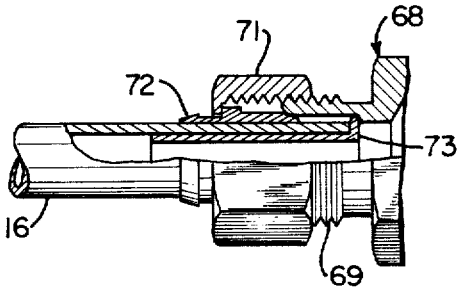
FIG. 7 is an enlarged view partially in section of one of the fittings employed in the system of the present invention.

In order to facilitate installation of the system and, in particular, the interconnection of the various supply, branch lines, and risers, compression fittings of the types illustrated in FIG. 7 may be employed, for example, at the tee and elbow joints between the tubing or pipe sections. Specifically, each fitting includes a body 68 provided with a coupling portion at each free or connecting end as designated at 69. A nut 71 causes a sleeve 72 to bear against the end of the tube or line, such as, the tube 16 and to force the tube 16 against the reinforced insert 73 to secure the parts in sealed relation. The body 68 of the fitting is provided with a corresponding coupling 69 at each free end, not shown, for connection to another tubing or pipe section thereto. Thus, the body 68 may be an elbow or tee with a corresponding coupling portion 69 at each end to receive the free end of each tube. Other fittings can be employed but the unit described enables quick assembly and connection by the homeowner without soldering and the like.

Figure 8:
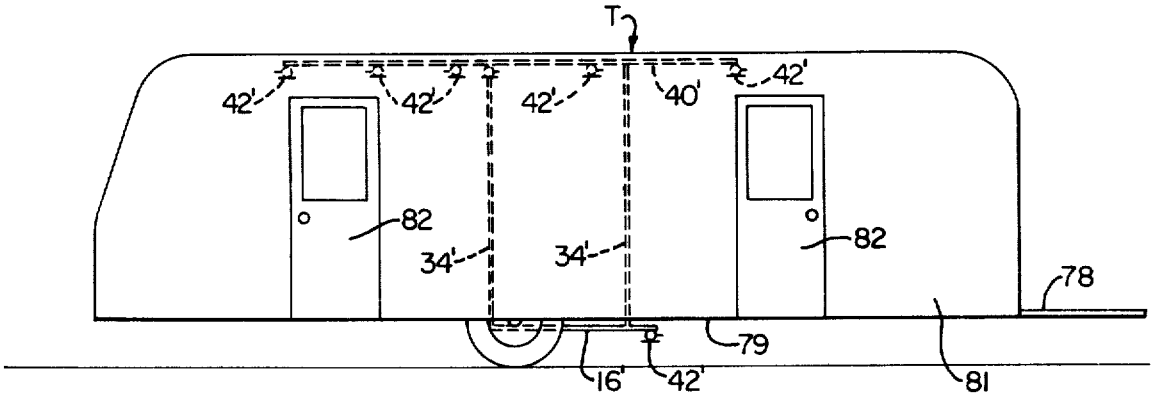
FIG. 8 is a side view schematically illustrating a modified form of fire protection system mounted in a mobile home trailer.
Figure 9:
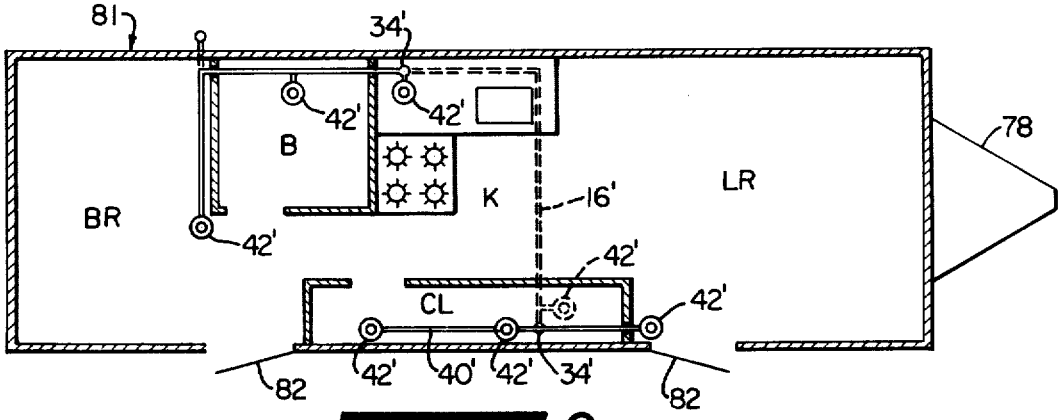
FIG. 9 is a top plan view of the modified form shown in FIG. 8.

FIGS. 8 and 9 show the installation of a somewhat modified form of fire protection system, in accordance with the present invention, in a travel trailer T wherein the trailer has a conventional tow-bar 78 and a lower chassis or floor 79 mounted on wheels 80. A living area is defined by an outer shell or enclosure 81 having suitable access doors 82; and for the purpose of illustration and not limitation, the travel trailer may be appropriately provided with a kitchen area designated at K, a bathroom B, closet CL, livingroom area LR and bedroom BR. The fire protection system is comprised of a centrally located inlet supply line 16' which in a manner corresponding to that described in FIG. 3 comprises a fitting adapted for attachment to a domestic water supply, and a dual check valve 25 and water flow switch 26 are mounted in the inlet supply line, although not illustrated in FIGS. 8 and 9. As best seen from the floor plan of FIG. 9, the inlet line 16' extends beneath the floor 79 across the substantial width of the trailer and has a first riser 34' extending upwardly through the floor 79 in the closet area CL and a second riser 34' extending upwardly through the kitchen area K. An upper branch line 40' extends horizontally through the upper space in the closet area and has a plurality of series-connected sprinkler heads 42', two being located within the closet area and one located adjacent to one of the access doors 82. A sprinkler head 42' is located in the inlet supply line 34' beneath the flooring in a location beneath the closet area. Further, the second riser 34' which extends into the kitchen area has a plurality of series-connected sprinkler heads 42', one being located in the kitchen area, a second being located in the bathroom area and a third being located in the bedroom area as illustrated. Although not shown, an inspection test line may be connected beneath the flooring 79 corresponding to the branch line 20', manual control valve 32 and orifice 30, as shown in FIG. 3. Similarly, the only suspension or mounting required is the utilization of hanger brackets corresponding to the hangers 22 shown in FIGS. 5 and 6 at spaced locations beneath the flooring; and where desired hanger brackets may be employed to affix the risers to the interior walls of the trailer or to affix the upper branch lines 40' to the ceiling or roof of the trailer. Again, the electrical control circuit for the system, although not shown, corresponds to that of the preferred form, each sprinkler head being automatically and independently energizable in response to an increase in temperature in a given area of the trailer to discharge water or other fire retardant materials into the room, and the shunt trip breaker will operate in response to opening of any one or more of the sprinkler heads to interrupt electrical service to the trailer and cut off the gas supply while activating the alarm circuit.

From the foregoing, it will be appreciated that a novel and improved fire protection system has been provided which is self-contained and can be mounted and installed by the novice in free-standing relation within the interior of a building, home and the like but having particular application to mobile homes and travel trailers. For the purpose of illustration, the inlet supply line 16 or 16' as well as the branch lines 20 may consist of ¾" or 1" pipe or tubing. The fittings or connections for the various lines in the modified form may be of the compression type as described and shown with respect to FIG. 7 so as to be readily disassembled, for example, whenever the trailer is to be moved to another site. In this relation, although the system may be left assembled when the trailer is being moved or transported, only the major points of connection between the risers, upper branch lines and the lower supply lines need be disconnected and stored during travel. Thus, a fire protection system has been devised which contains all of the advantages, if not more than, the more permanent fire protection installations. It is a fully automatic and self-contained system which requires a minimum of amount piping or conduit to cover the largest possible area while automatically interrupting both the gas and electrical service to the enclosure while activating an alarm circuit and providing a continuous supply of water to one or more of the sprinkler heads until the fire is put out.

It is therefore to be understood from the foregoing that while preferred and modified forms of the present invention have been set forth, it should be appreciated by those skilled in the art that various modifications, changes and adaptations may be made without departing from the scope of the present invention as defined by the following claims.

I claim:

1. A fire extinguishing and alarm system adapted for installation in a building structure wherein the building has a raised floor spaced above a ground surface, outer enclosing walls and interior walls dividing said building into a plurality of rooms, an outside source of electricity including an electrical service panel positioned externally of said building, a gas supply source including a solenoid operated gas shut-off valve, and a source of water supply under pressure, said fire protection system comprising:

a sprinkler system including at least one inlet delivery line extending from said water supply source including check valve means therein suspended beneath said raised floor externally of said building, said check valve means operative to prevent reverse flow of liquid from said system into said water supply source, at least one riser extending upwardly from said delivery line through said floor into the interior of said building structure, a horizontally extending supply line connected to the upper end of said riser, a plurality of sprinkler heads connected in series at spaced intervals along each said horizontal supply line, each said sprinkler head including valve means operative to be activated in response to a predetermined temperature level to discharge water under pressure therefrom independently of the other of said valve means;

alarm circuit means disposed externally of said building and operative to be electrically activated to sound an alarm; and electrical control circuit means electrically connected between said electrical power source, said gas shut-off valve and said alarm circuit means, said control circuit means including sensing means responsive to activation of at least one of said sprinkler heads to interrupt the electrical service from said electrical service panel to said building structure, to interrupt the gas supply to the building structure by closing the solenoid operated gas shut-off valve and simultaneously activating said alarm circuit, said sensing means defined by a water flow switch in said delivery line externally of said building which is operative in response to opening of at least one of said sprinkler heads to activate said control circuit means.

2. A fire protection system according to claim 1, said riser extending in free-standing relation upwardly from said delivery line through said building.

3. A fire protection system according to claim 1, said delivery line including a branch line extending beneath said floor and including shut-off valve means to permit introduction of other liquids into said delivery line for mixture with the water.

4. A fire protection system according to claim 1, said control circuit means including an inlet power cord adapted to be plugged into said external source of electrical supply, said inlet power cord including positive, neutral and ground wires, and a second cable extending from said control circuit means to a conventional circuit breaker provided in said mobile home, said second cable including a positive, negative and ground wire.

5. A fire protection system according to claim 4, said control circuit means being a shunt trip circuit including shunt connections connected in parallel across said positive lead from said external source of electricity to said alarm circuit means, said gas shut-off valve and said water flow switch.

6. A fire protection system according to claim 5, said control circuit means including a parallel connection between said positive lead from said external source of electricity and said conventional circuit breaker in said mobile home.

7. A fire protection system according to claim 6, said water flow switch being a normally open switch movable to a closed position in response to water flow through said delivery line to interrupt said circuit between the positive side of said inlet power cable and the positive side of said cable leading to said circuit breaker and to said gas shut-off valve while making said circuit from the positive side of said power cable to said alarm circuit means.

8. A fire protection system according to claim 7, said alarm circuit means including a series-connected light and audible alarm.

9. A self-contained fire extinguishing and alarm system adapted for installation in a mobile home wherein the mobile home has a raised floor elevated above a ground surface, outer walls and interior walls dividing said mobile home into a plurality of rooms, an outside source of electricity including an electrical service panel positioned externally of said mobile home, a gas supply source including a solenoid operated gas shut-off valve, and a source of water supply under pressure, said fire protection system comprising:

a sprinkler system including at least one inlet delivery line extending from said water supply source beneath said raised floor externally of said mobile home and being suspended beneath said floor, check valve means in said delivery line externally of said mobile home to prevent reverse flow of liquid from said system into said water supply source, a water flow switch in said delivery line externally of said mobile home disposed downstream of said check valve means, at least one riser extending upwardly from said delivery line in free-standing relation through said floor into the interior of said mobile home, a horizontally extending supply line connected to the upper end of said riser, a plurality of sprinkler heads connected to said horizontal supply lines, each said sprinkler head having heat-activated valve means operative to open in response to a predetermined temperature level whereby to discharge water under pressure through its respective sprinkler head and said valve means being further operative to automatically shut off its respective sprinkler head upon reduction of the temperature below a predetermined level;

alarm circuit means disposed externally of said mobile home and operative to be electrically activated to sound an alarm; and electrical control circuit means electrically connected between said electrical service panel, said gas shut-off valve and said alarm circuit means, said control circuit means being responsive to activation of at least one of said sprinkler heads to interrupt the electrical service from said electrical service panel to said mobile home and to interrupt the gas supply to the mobile home by closing said gas shut-off valve while activating said alarm circuit means.

10. A fire protection system according to claim 9, said delivery line including a branch line extending beneath said floor externally of said mobile home and including shut-off valve means to permit introduction of other liquids into said delivery line for mixture with the water.

11. A fire protection system according to claim 10, said control circuit means including an inlet power cord adapted to be connected to said external source of electrical supply, said inlet power cord including positive, neutral and ground wires, and a second cable extending from said control circuit means to a conventional circuit breaker provided in said mobile home, said second cable including a positive, negative and ground wire, and parallel shunt connections across said positive lead from said external source of electricity to said alarm circuit means, said gas shut-off valve and said water flow switch.

12. A fire protection system according to claim 11, said water flow switch being a normally open switch movable to a closed position in response to water flow through said delivery line to interrupt said control circuit means; and between the positive side of said inlet power cable and the positive side of said cable leading to said circuit breaker and to said gas shut-off valve while making said control circuit means from the positive side of said power cable to said alarm circuit means.

* * * * *